US005904019A

United States Patent [19]

Kooij et al.

[11] Patent Number: 5,904,019

[45] Date of Patent: May 18, 1999

[54] THERMOPLASTIC BUILDING BLOCKS

[75] Inventors: Gert-Jan Kooij, Papendrecht; Roy Gilsing, Rotterdam, both of Netherlands; Christophe Serge Moinat, Vaud, Switzerland; Barry Raymond Worsley, Rucphen, Netherlands

[73] Assignee: General Electric Company, Pittsfield, Mass.

[21] Appl. No.: 08/914,687

[22] Filed: Aug. 19, 1997

[51] Int. Cl.[6] ..... E04C 1/42

[52] U.S. Cl. ..... 52/306; 52/580; 52/591.5; 52/592.2; 52/604; 52/792.1

[58] Field of Search ..... 52/306, 307, 308, 52/580, 127.3, 408.3, 591.5, 596, 574, 592.2, 592.4, 792.1, 387, 783.1, 604

[56] References Cited

U.S. PATENT DOCUMENTS

| | | | |
|---|---|---|---|
| 4,632,589 | 12/1986 | Hsiu . | |
| 4,719,735 | 1/1988 | Fleming, Jr. et al. | 52/306 |
| 4,793,104 | 12/1988 | Hultberg et al. . | |
| 4,891,925 | 1/1990 | Carlson et al. . | |
| 4,941,302 | 7/1990 | Barry | 52/306 X |
| 5,033,245 | 7/1991 | Kline . | |
| 5,367,846 | 11/1994 | VonRoenn, Jr. | 52/308 |
| 5,588,271 | 12/1996 | Pitchford | 52/306 |

FOREIGN PATENT DOCUMENTS

| | | | |
|---|---|---|---|
| 169151 | 2/1951 | Austria | 52/306 |
| 0 368 479 B1 | 10/1989 | European Pat. Off. . | |
| 0 452 879 B1 | 6/1994 | European Pat. Off. . | |
| 1401279 | 4/1965 | France | 52/306 |

*Primary Examiner*—Winnie G. Yip

[57] ABSTRACT

A thermoplastic building block consisting of a hollow block molded out of a thermoplastic resin such as an aromatic polycarbonate resin. The block has molded flanges extending outwardly from the outer surfaces of the block. The flanges have interlocking means such as ribs on the under side of the extended flanges so as to join the corresponding outer flange of an adjacent block. The joining means do not require the need for cementing or adhesive bonding the flanges together. The block may be used to form a straight or curved wall.

11 Claims, 4 Drawing Sheets

THERMOPLASTIC BUILDING BLOCKS

FIELD OF THE INVENTION

This invention relates to novel thermoplastic building blocks, particularly transparent or translucent building blocks made from polycarbonate resin. The blocks may be hollow and are suitable for wall construction, particularly decorative wall construction. One feature of this invention is that the wall is movable without significant construction requirement as would be required with cemented or grouted glass or other plastic blocks.

BACKGROUND OF THE INVENTION

Plastic blocks for use in erecting walls whether they may be decorative or otherwise, are becoming more popular. Such plastic blocks are known and there are patents covering various types of blocks and designs with respect to wall construction using plastic blocks. Several patents in the area of plastic blocks are U.S. Pat. No. 4,632,589; U.S. Pat. No. 4,891,925; U.S. Pat. No. 4,793,104 and U.S. Pat. No. 5,033,245.

In comparison to glass blocks, plastic blocks are inexpensive, easily produced and provide aesthetically appealing modular wall structures both for interior and exterior decorative walls. Plastic building blocks provide a number of advantages over conventional glass building blocks, such as, they are lighter in weight, have better impact resistance, generally have better optical clarity, are generally less expensive to make and may be easier to incorporate decorative features in a plastic block, and allows an interlocking system as part of the plastic block.

Several of the above patents disclose plastic blocks and these are U.S. Pat. Nos. 4,891,925 and 5,033,245. U.S. Pat. No. 4,891,925 discloses a plastic block having special inter-connecting means without the need for motor or adhesive joining of the blocks. The blocks of the reference are joined by a spanning member having ends adjusted for engaging in cavities of two adjacent blocks which can then be connected to form a unified straight wall structure. However, the patent discloses using grouting, once a partition is erected, to cover the recessed spacing flanges between the faces of the blocks (col. 3, lines 54–55).

U.S. Pat. No. 5,033,245 is directed to decorative architectural building blocks which are generally a plurality of halves joined together along a seam to form a hollow block. The outer surfaces may be surfaced with a transparent, abrasion, chemical and/or ultraviolet light resistant coating. The blocks are assembled and joined together adhesively (Col. 3 lines 1–10), with such adhesive as RTV silicones or other adhesives which can be utilized in place of conventional motor (Col. 1, lines 29–32).

SUMMARY OF THE INVENTION

A unique and superior design for plastic blocks has been developed with snap-click-in or snap-fit interlocking means. These unique plastic blocks are a single unit made generally from essentially two identical halves. Walls can be constructed as a do-it yourself (DIY) project; have high esthetics; have high acoustic insulation particularly for polycarbonate molded blocks; and have architectural configuration possibilities, i. e. blocks may be angled with respect to each other and thus one can create a curved wall in horizontal or vertical directions. A wall constructed of the blocks of this invention is not a fixed wall and can be considered as moveable. As such, permission or building certificate may not be needed to build walls in a building. Because of the unique blocks herein disclosed, a wall constructed of the block of this invention can be, assembled, disassembled and re-assembled.

Briefly, the invention of this application comprises thermoplastic resin molded blocks having means to join adjacent blocks by means of flanges with interlocking means.

DETAILED DESCRIPTION OF THE INVENTION AND DRAWINGS

Figure 1A:
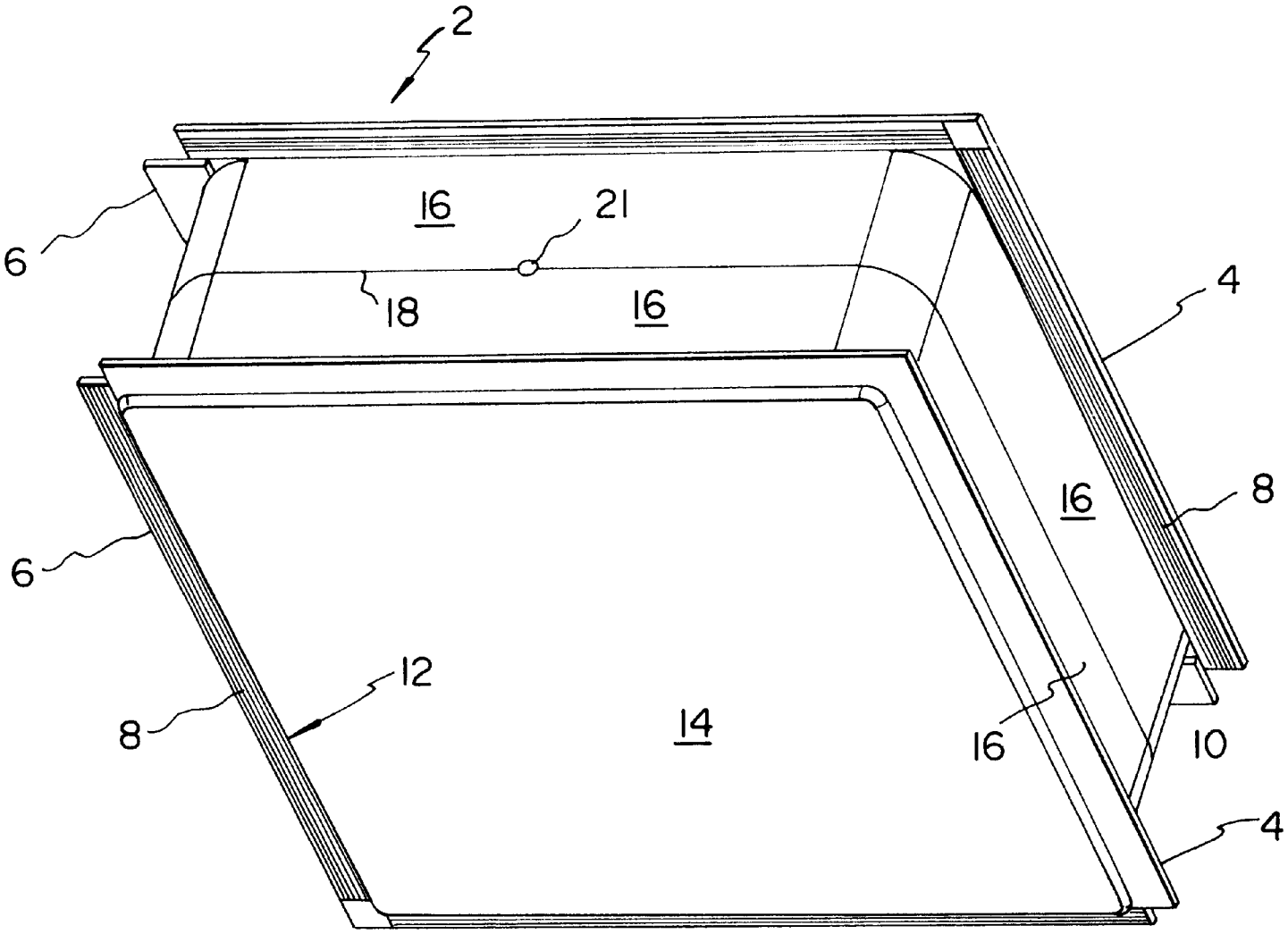
FIG. 1 (*a*) and (*b*) are schematic views of the thermoplastic block of this invention with and without a textured surface.

In constructing a wall with the thermoplastic blocks of this invention, the front and back faces of the blocks may be positioned vertically. The block is a hollow thermoplastic block with flanges on all four sides. The block is symmetrical in the mid-plane that is parallel to the front and back surface of the block. Except for the front and back side, each side has two flanges. The inner flanges are positioned on two adjacent sides, and the outer flanges are positioned on the other two adjacent sides. Two outer flanges of one block interlock with two inner flanges of an adjacent block. When connecting two blocks together, two blocks that interlock are positioned equally in a front view, then the two adjacent outer flanges of the two blocks are positioned in the same direction. In this manner, blocks can be connected sideways as well as from bottom to top and thus create a wall. The two adjacent outer flanges close off the corners where four blocks come together. When the blocks are connected, the outer flanges will create a flush and finished surface.

Each flange has an outer and an inner surface. The flanges consist of a pair of inner flanges and a pair of outer flanges. As stated previously, the inner flanges are positioned on two adjacent sides and the outer flanges are positioned on the other two adjacent sides. Each of the flanges have interlocking means which are molded as part of the flange and plastic block. The interlocking means may be selected from a variety of different interlocking means and may consist of grooves, ribs, tongue and grooves, or any means that can allow snap-fit of the blocks together and can be molded as part of the block during molding.

With respect to the interlocking means, the outer flanges have the interlocking means on the inside surface of the flange. The inner flanges have the interlocking means on the outer surface of the flange.

In one embodiment of this invention, it may be desirable that the outer flanges have on the outer surface thereof a textured surface. The texture may be any texture that can be molded in the surface during molding of the plastic block. The texture may consist of lines or leather like or grainy or the like. Such a textured surface provides the advantage of being able to orientate the blocks during building a wall, i.e. the textured outer surface of the outer flanges of the block have the same orientation in an assembled wall. In addition, it provides orientation of two molded halves during assembly of the two halves to form a single plastic block. Further, the textured surface of the outer flanges tends to block the internal view of a transparent or translucent block.

With the multiple interlocking means as described above, the blocks can have more than one position relative to each other. Columns of blocks can be angled with respect to each other when seen from the top view and can thus create a curved wall in two directions. The dimension or configuration of the interlocking means and the distance on the flanges can define the radius of the curve of a wall designed with the thermoplastic block of this invention.

Referring to the drawings for a more detailed description of the instant invention, there is illustrated therein a new and unique architectural building block formed of a thermoplastic resin. In the practice of the invention, a thermoplastic resin is employed and may be a transparent, translucent or pigmented thermoplastic resin. In general, the light transmitting or transparent thermoplastic resins are preferred. The thermoplastic blocks may be prepared by injection molding, vacuum forming, thermoforming, blow molding or any other molding process for forming the thermoplastic blocks of this invention.

The thermoplastic blocks of this invention may be formed as a pair of halves which are at least essentially identical. The seam joint is generally intermediately spaced between and parallel of a pair of opposite outer side faces. The blocks may be generally rectangular or square and may have rounded corners, if so desired. Each half member may include an integrally molded continuous edge wall joined around the periphery of the side faces and extending inwardly thereof to a free inner edge forming a seam joint. The seam joint may be a tongue and groove connection or simply adhesively butting together two halves so that when the two halves are joined together or assembled, a hollow enclosure is formed. The interior of the block may thus be sealed off against the intrusion or entry of outside elements or may have a vent hole to allow the dissipation of moisture to the atmosphere.

Figure 1B:
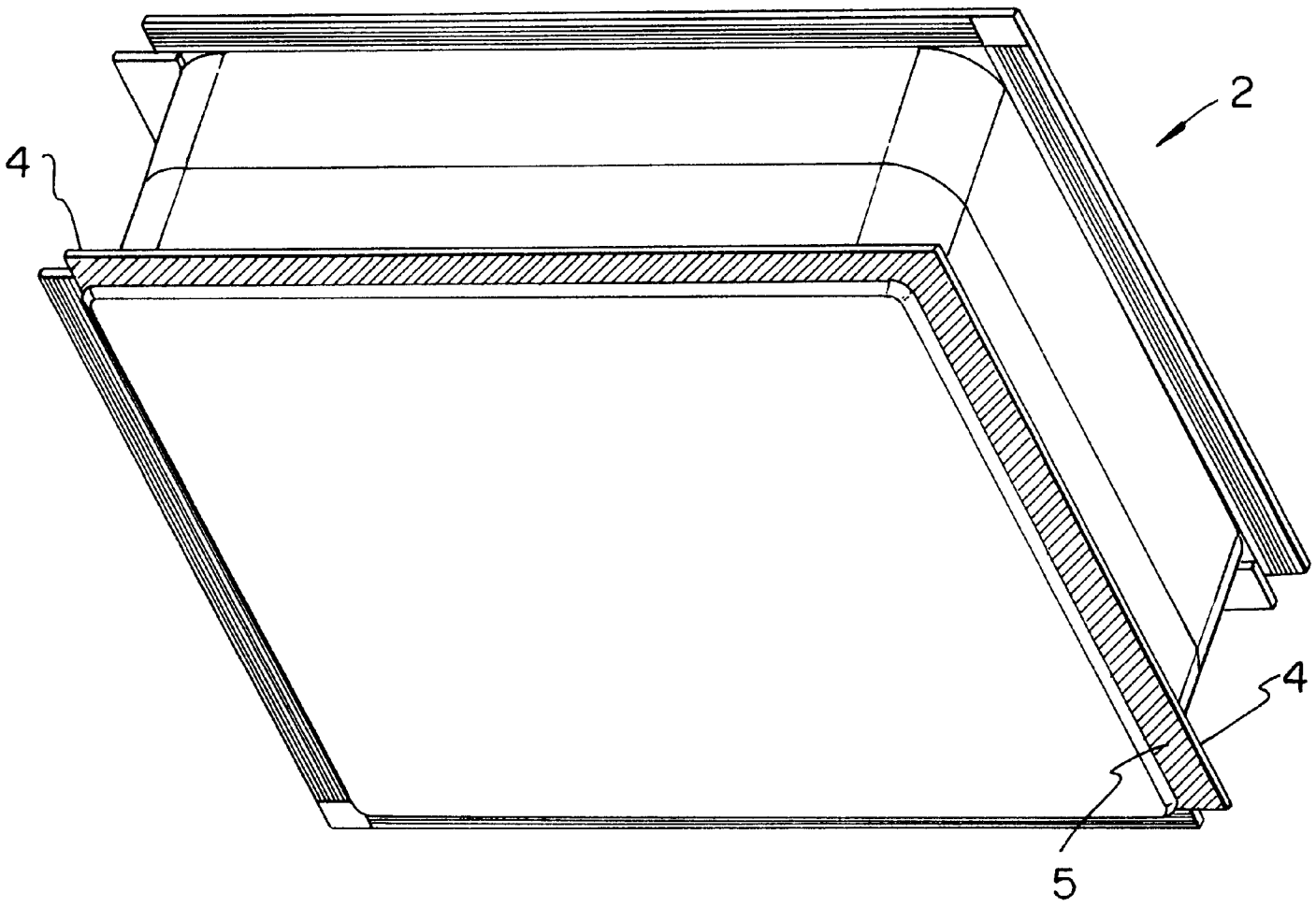

Referring to the drawings, FIG. 1 (*a*) is a schematic view of block 2 of the invention with molded insitu outer flange 4 and inner flange 6. FIG. 1 shows one embodiment of the interconnecting means namely ribs 8. Ribs 8 are molded on underside 10 of outer flanges 4 and the outer side 12 of inner flanges 6. Surface 14 is the front surface of block 2 with an identical surface (not shown) opposite surface 14. The side surfaces 16 form the edge surfaces of block 2. In the embodiment, seam line 18 is a result of welding or bonding the two half sections together and vent opening 21 allows moisture or other gaseous elements to dissipate into the atmosphere.

FIG. 1 (*b*) is the same schematic view of block 2 of FIG. 1 (*a*) except that outer flanges 4 have textured surface 5 consisting of lines in this embodiment. All other parts are the same as set forth in FIG. 1 (*a*).

Figure 2A:
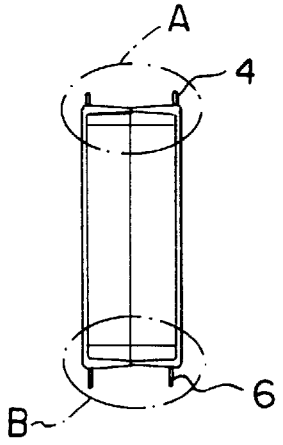
FIG. 2 (*a*) and (*b*) are top views of a section of the connecting means of adjacent thermoplastic blocks with Detail A and B enlarged.
Figure 2B:
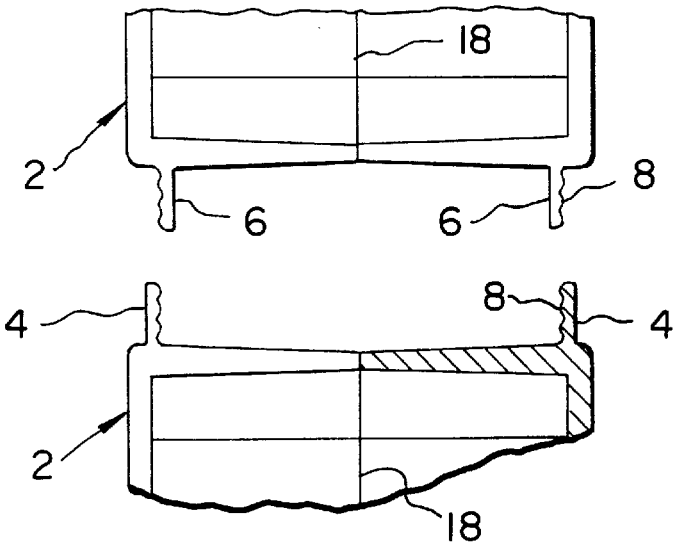

FIG. 2 (*a*) is a top view of a single block showing outer flanges 4 and inner flanges 6. FIG. 2 (*b*) is a top view of the section of the connecting means for joining the blocks together comprising outer flanges 4 with ribs 8, inner flanges 6 with ribs 8 and seam line 18 of block 2 showing an enlargement of detail A of the block of FIG. 2 (*a*), and an enlargement of detail B of an adjacent block although one block is shown since each block is essentially the same.

Figure 3A:
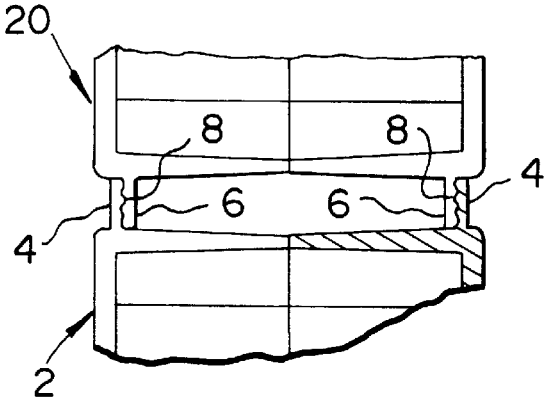
FIG. 3 (*a*), (*b*) and (*c*) are top views showing various locking positions of the thermoplastic blocks of this invention.
Figure 3B:
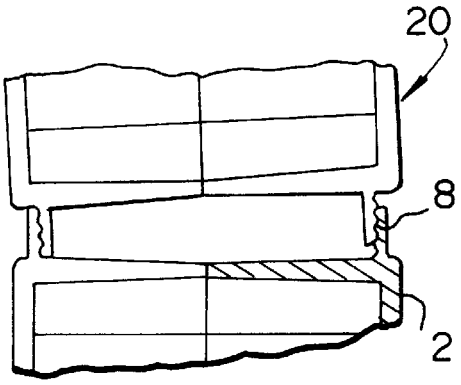
Figure 3C:
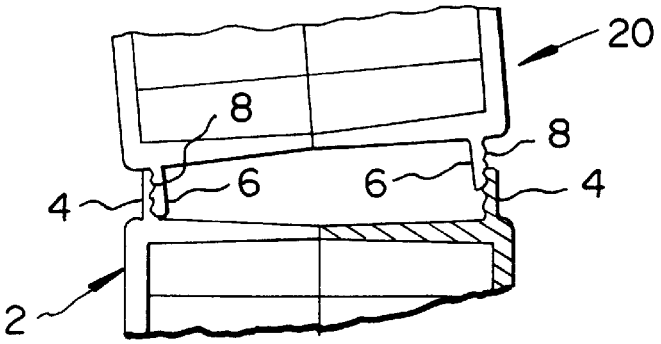

FIG. 3(*a*), (*b*) and (*c*) illustrates the joining or connecting of two adjacent blocks FIG. 3(*a*) for a straight wall wherein ribs 8 of outer flange 4 and inner flange 6 join in a snap-fit without the need of motor or an adhesive. FIG. 3(*b*) illustrates how two adjacent blocks can be joined to form a curved wall by joining (snap-fit) only a portion of ribs 8 of outer flange 4 to the ribs of inner flange 6 of one side of block 2 and block 20. On the other side of block 2 and block 20, the ribs are fully joined by snap-fit of ribs 8 of outer flange 4 and the ribs of inner flange 6. FIG. 3(*c*) illustrates another alternative for forming a curved wall by snap-fitting fewer of ribs 8 of outer flange 4 and the ribs of inner flange 6 on one side of block 2 and block 20. On the other side of blocks 2 and 20, essentially all of ribs 8 of outer flange 4 and the ribs of inner flange 6 are joined by snap-fitting ribs 8.

Figure 4B:
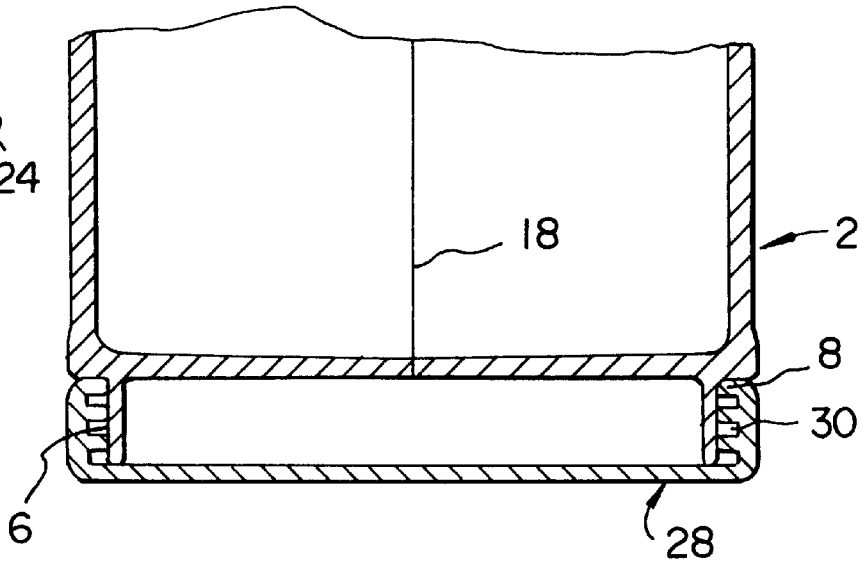
FIG. 4 (*a*) and (*b*) are section views showing connecting means to a profile (i. e. bottom row of thermoplastic blocks to a floor or top row to a ceiling).
Figure 4A:
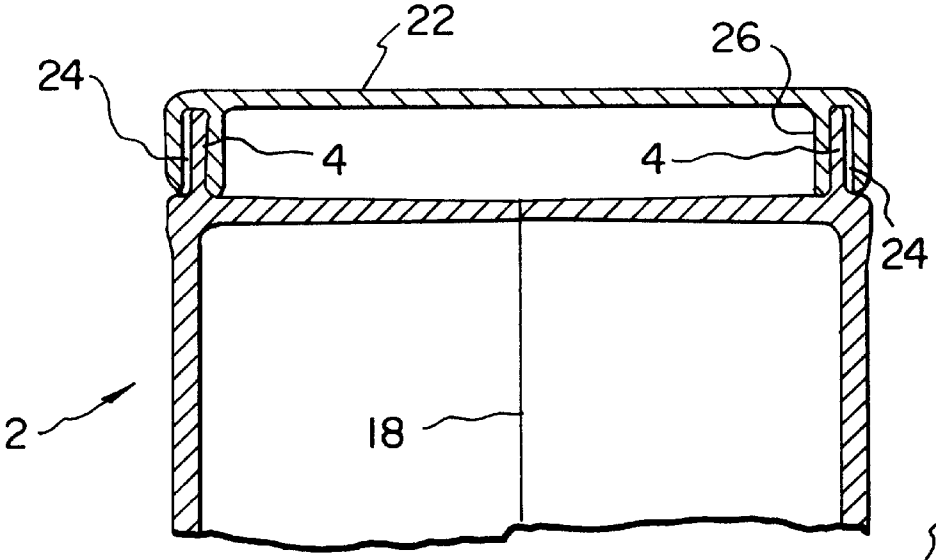

FIG. 4 (*a*) is a sectional view showing one embodiment, for connecting the top row of a wall of thermoplastic blocks 2 of this invention, for example, to a ceiling line, in order to finish the sides of a wall at the ceiling. Connecting means 22 consists of slots 24 wherein in the embodiment outer flange 4 is inserted into slot 24. Sides 26 of slot 24 provide a finish to the edge of a wall at the ceiling. FIG. 4(*a*) also shows seam line 18.

FIG. 4(*b*) illustrates one means for connecting a wall of thermoplastic blocks of the invention to a floor in order to finish the sides of the wall at the floor line. Connecting means 28 receive inner flange 6 of block 2 such that ribs 8 snap fit into grooves 30 of connecting means 28 which secures block 2 to connecting means 28 and showing seam line 18.

While FIG. 4(*a*) and (*b*) illustrate a ceiling 4(*a*) and a floor 4(*b*) connecting means, they may be reversed in that the ceiling connection may be used as a floor connecting means and the floor connecting means may be used as a ceiling connecting means. These connecting means may be employed with a frame of any other structure other than a wall or ceiling.

In the practice of this invention, the flanges and interlocking sections of the flanges are molded in one operation in the molding of the thermoplastic block. The interlocking means may be any configuration, as stated previously, such as grooves or tongue and groove or ribs or any other means that can result in a snap-fit or tight connection between joining sections on the flanges of adjacent blocks.

In molding the thermoplastic blocks of this invention, any molding means may be employed as described previously. The molding means are not critical to the practice of this invention. The thermoplastic block with the interlocking means as part of the flanges is a critical feature of the invention such that the blocks can be joined together by merely snap-fitting the blocks through the interlocking means on the flanges. By connecting the blocks of this invention by the unique means disclosed herein, straight or curved walls may be erected without the need of motor or an adhesive. As such, walls may be easily erected and essentially as easily disassembled on a do-it-yourself basis and without the need of construction material i. e. cement, adhesive, etc., other than just the blocks.

The blocks of this invention may also have a coating over the surface of the block. The coating is generally a clear coating and may be an abrasion or scratch resistant coating or the coating may be a UV resistant coating, an acrylic coating, a flame retardant coating or such other coating for purposes of abrasion resistance, chemical resistance, or the like. The coating is generally applied as a secondary operation such as flow coating, dip coating, spray coating, roller coating, and the like for applying coatings to thermoplastic substrates. These coatings include, but are not limited thereto, polysiloxanes, silica filled polysiloxanes, UV resistant acrylic coatings, and the like.

Since the thermoplastic blocks of this invention have better resistance to impact than glass blocks, they are therefore more resistant to vandalism abuse such as the throwing of rocks, bottles, etc. Thus, these blocks may be installed in areas previously considered unsafe or hazardous.

The thermoplastic blocks of this invention are architectural building blocks formed by molding a thermoplastic resin wherein the thermoplastic block comprises a hollow (polygonal shape) rectangular three dimensional thermoplastic resin block having interlocking means for joining two or more blocks to form a wall without the need of adhesive materials, and comprising two outer opposite essentially flat surfaces separated and joined around the periphery by wall segments normal to said two outer opposite essentially flat surfaces, said outer flat surfaces having flange means on all edges of each surface aligned to extend outwardly of said outer flat surface for at least partially filling a precise amount of space established between a pair of adjacent blocks when said blocks are positioned as a segment of a wall, said flange means comprising outer and inner flanges wherein each flat surface has two adjacent outer flanges and two adjacent inner flanges, said outer flanges have interlocking snap-fitting means facing inwardly from one flat outer surface and said inner flanges have interlocking snap-fitting means facing outwardly from the same flat outer surface such that the outer flanges with interlocking means facing inwardly engage the interlocking means facing outwardly of the inner flanges for securing and interlocking an adjacent block thereby forming a segment of a wall.

Any moldable thermoplastic resin may be employed in molding the thermoplastic blocks of this invention. The resins may include aromatic carbonate homopolymers, copolymers, ester carbonate polymers; alkyl terephthalate polymers such as polybutylene terephthalate; olifin polymers such as polypropylene; and other polymers or blends thereof. The thermoplastic blocks of this invention may be transparent, translucent or opaque. The preferred thermoplastic rein is aromatic polycarbonate resin that is essentially transparent upon molding.

While many modifications and variations of the present invention are possible in view of the fore-going specifications, it is to be understood that they would fall within the scope of the appended claims.

What is claimed is:

1. An architectural molded thermoplastic resin building block comprising a hollow rectangular thermoplastic resin block with flanges and snap-fit interlocking means on said flanges for joining at least two said blocks without the need of an adhesive material, said block comprising two outer opposite essentially flat surfaces separated and joined by peripheral wall segments normal to said two outer opposite essentially flat surfaces, each outer opposite essentially flat surface has four flanges intergrately molded as part of the thermoplastic outer edges of the block such that each flange has an inner and outer surface and is aligned to extend outwardly from each said outer essentially flat surface for at least partially filling a precise amount of space established between a pair of adjacent blocks when at least two of said blocks are positioned as a segment of a wall, said four flanges consisting essentially of two outer and two inner flanges wherein each outer essentially flat surface has two adjacent outer flanges and two adjacent inner flanges, said outer flanges have the interlocking snap-fit means on the inner surface of the flanges facing inwardly from one said outer essentially flat surface and said inner flanges have the interlocking snap-fit means on the outer surface of the flanges facing outwardly from the same said outer essentially flat surface such that the outer flanges with the interlocking means facing inwardly adapted to engage the interlocking means facing outwardly from the inner flanges of an adjacent block for securing and interlocking the adjacent block thereby forming a segment of a wall.

2. The building block of claim 1 wherein the interlocking means on the flanges are ribs.

3. The building block of claim 1 wherein the interlocking means on the flanges are tongue and groove such that one flange has grooves and the flange of the adjacent block has tongues so as to be joined as to interlocked by the tongue and groove.

4. The building block of claim 1 wherein the block is transparent.

5. The building block of claim 1 wherein the block is molded of an aromatic polycarbonate resin.

6. The building block of claim 1 wherein the block has at least one vent in the peripheral wall segment.

7. The building block of claim 1 wherein the outer surface of the outer flanges have a texture on said outer surface.

8. The building block of claim 1 wherein at least one of the outer surfaces has s coating thereon.

9. The building block of claim 8 wherein the coating is a clear abrasion resistant coating.

10. A wall comprises a plurality of the building blocks according to claim 1, wherein the flange of each adjacent building blocks are interlocked.

11. The wall of claim 10 wherein the wall is curved.

* * * * *